US006325372B1

(12) United States Patent
Chen

(10) Patent No.: US 6,325,372 B1
(45) Date of Patent: Dec. 4, 2001

(54) FOOT SHELL OF A TOY FOOTBALL PLAYER FOR A TOY FOOTBALL FIELD

(75) Inventor: Ying Tse Chen, Yung Kang (TW)

(73) Assignee: Pai Li Business Co., LTD, Tainan Hsien (TW)

( * ) Notice: Subject to any disclaimer, the term of this patent is extended or adjusted under 35 U.S.C. 154(b) by 0 days.

(21) Appl. No.: 09/525,274

(22) Filed: Mar. 14, 2000

(51) Int. Cl.[7] ..... A63F 7/07

(52) U.S. Cl. ..... 273/108.1; 273/108.52; 273/108.54

(58) Field of Search ..... 273/108.52, 108.54, 273/108.55, 108.56, 119 R, 126 R, 129 R, 108.53, 108.51, 108.1, 108.22; D21/318, 356, 386; 446/366, 367; 473/325

(56) References Cited

U.S. PATENT DOCUMENTS 3,995,859 * 12/1976 Goldfarb .
4,046,378 * 9/1977 Furr .
4,290,606 * 9/1981 Maxwell .

FOREIGN PATENT DOCUMENTS

3046466 * 7/1982 (DE) ..... 273/85 D
701847 * 1/1954 (GB) ..... 273/85 F
508780 * 1/1955 (IT) ..... 273/85 D
532808 * 9/1955 (IT) ..... 273/85 C
535734 * 11/1955 (IT) ..... 273/85 F

* cited by examiner

*Primary Examiner*—Sebastiano Passaniti
(74) *Attorney, Agent, or Firm*—Pro-Techtor International Services

(57) ABSTRACT

A foot shell of a toy football player for a toy football field is made integral of a soft material and has a hollow interior. The foot shell is fixed around a ball kicking block of a foot of the toy football player, having a concave surface formed in a front side and provided with a plurality of vertical rough stripes. Then the concave surface with the stripes may have a similar good function in stopping and stabilizing a football just in the way a true football player uses an inner curved side of a foot in stopping and stabilizing the ball.

2 Claims, 4 Drawing Sheets

FOOT SHELL OF A TOY FOOTBALL PLAYER FOR A TOY FOOTBALL FIELD

BACKGROUND OF THE INVENTION

This invention relates to a foot shell of a toy football player for a toy football field, particularly to one effectively stopping a football, stabilizing and controlling it easily.

A conventional toy football player for a toy football field is generally made of a hard plastic, shaped similar to a true human form, having a ball kicking block formed in the foot portion, whereby the toy player may kick the ball to roll towards the opposite team field or to kick the ball into the opposite goal. So the ball kicking block not only has offensive function to kick the ball, but also defending function to stop and stabilizing the ball. Nevertheless, the ball kicking block may produce counter function to permit the ball rebound away when the ball rolls to hit the ball kicking block because of the hard material the ball and the ball kicking block are both made of. So a known conventional foot shell 10 of a toy football player shown in FIG. 1 has been disclosed, made of a soft material and having a hollow interior, a flat ball receiving surface 101 formed in a front side, a plurality of rough stripes 102 formed in the ball receiving surface 101, an insert hole 103 formed in an upper side, and a hollow interior 104 formed to communicate with the insert hole 103. Then the foot shell 10 is fixed around a ball kicking block 201 of a toy football player 20, with the insert hole 103 constricting an upper portion of the ball kicking block 201 not falling off the block 201, as shown in FIG. 2. Then the foot shell 10 produces a buffering effect owing to its softness, reducing rebounding force of the ball when the ball rolls and collide with it, and in addition, the rough stripes 102 may produce friction against the ball to reduce the speed of the ball and let it gradually cease to move. Next, the ball is adjusted in its position by the toy player and then kicked out to enhance its defense and offence effect as well.

But the known conventional foot shell 10 has been found to still have rebounding phenomenon against the ball 30 when it rolls toward the foot shell 10 in spite of some buffering and speed reducing effect the foot shell 10 has, as shown in FIG. 3. After research, it is found that the reason of ball rebound is caused by the rough stripes 102, limited in its friction against the ball in colliding only owing to point touch of the both. So it cannot surely stabilize the ball although it reduces the speed of the ball. As the fact that a human foot has its inner side shaped concave, the receiving surface 101 does not kick the ball just in the way a human foot kicks it, impossible to obtain the same effect in kicking the ball.

SUMMARY OF THE INVENTION

This invention has been devised to offer a foot shell of a toy football player for a toy football field, which has a concave surface in a front side of the foot shell, similar to the shape of a human foot so as to stop and stabilize the ball, upgrading defense and offence force.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
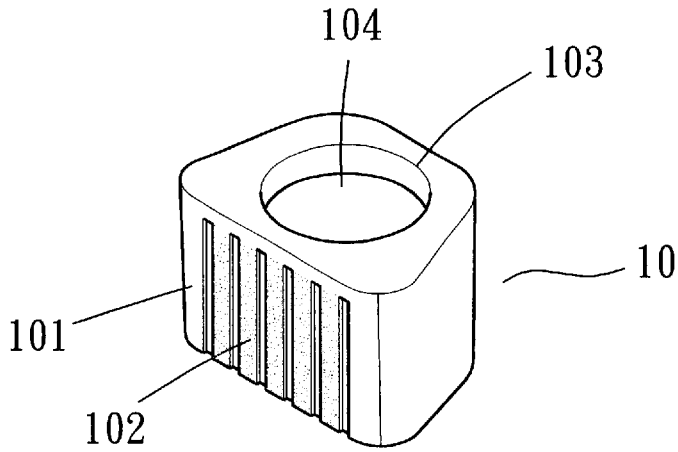
FIG. 1 (PRIOR ART)
FIG. 1 is a perspective view of a known conventional foot shell of a football player for a toy football field.
Figure 3:
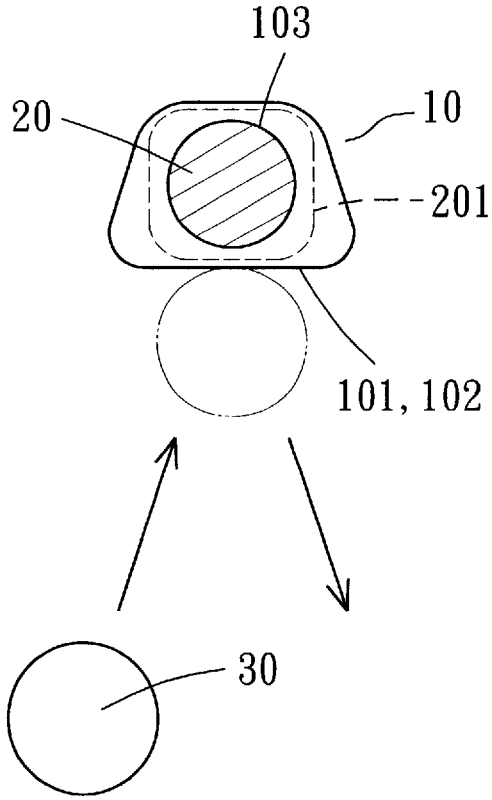
FIG. 3 (PRIOR ART)
FIG. 3 is an upper view of the known conventional foot shell of a football player in receiving and rebounding a ball.
Figure 2:
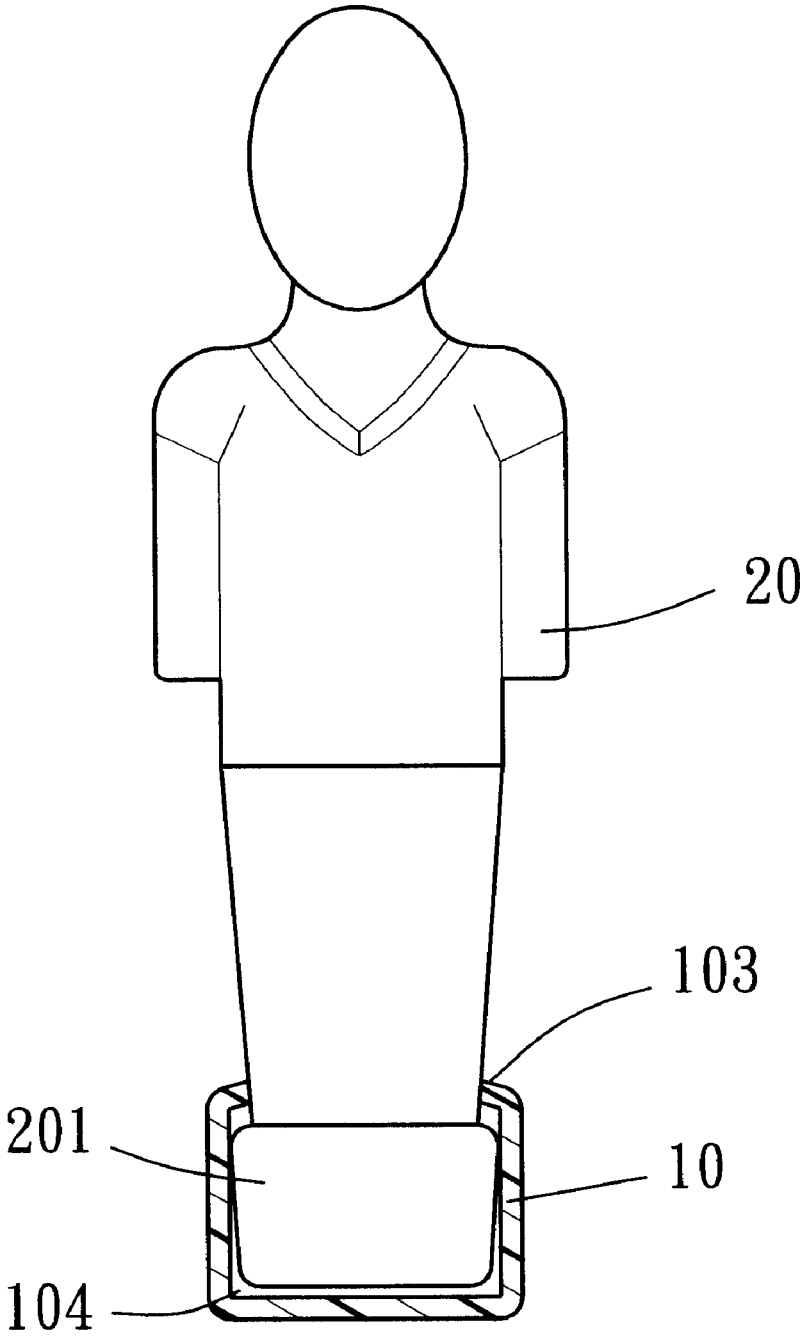
FIG. 2 (PRIOR ART)
FIG. 2 is a front view of the known conventional foot shell in the practical using condition.
Figure 4:
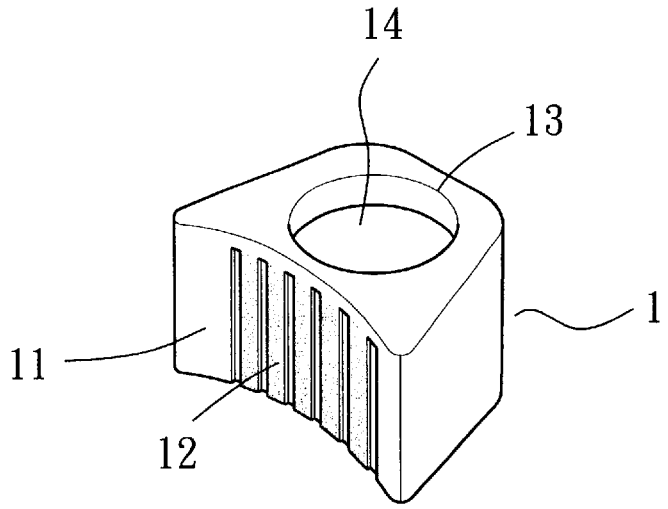
FIG. 4 is a perspective view of a foot shell of a toy football player for a toy football field in the present invention.
Figure 5:
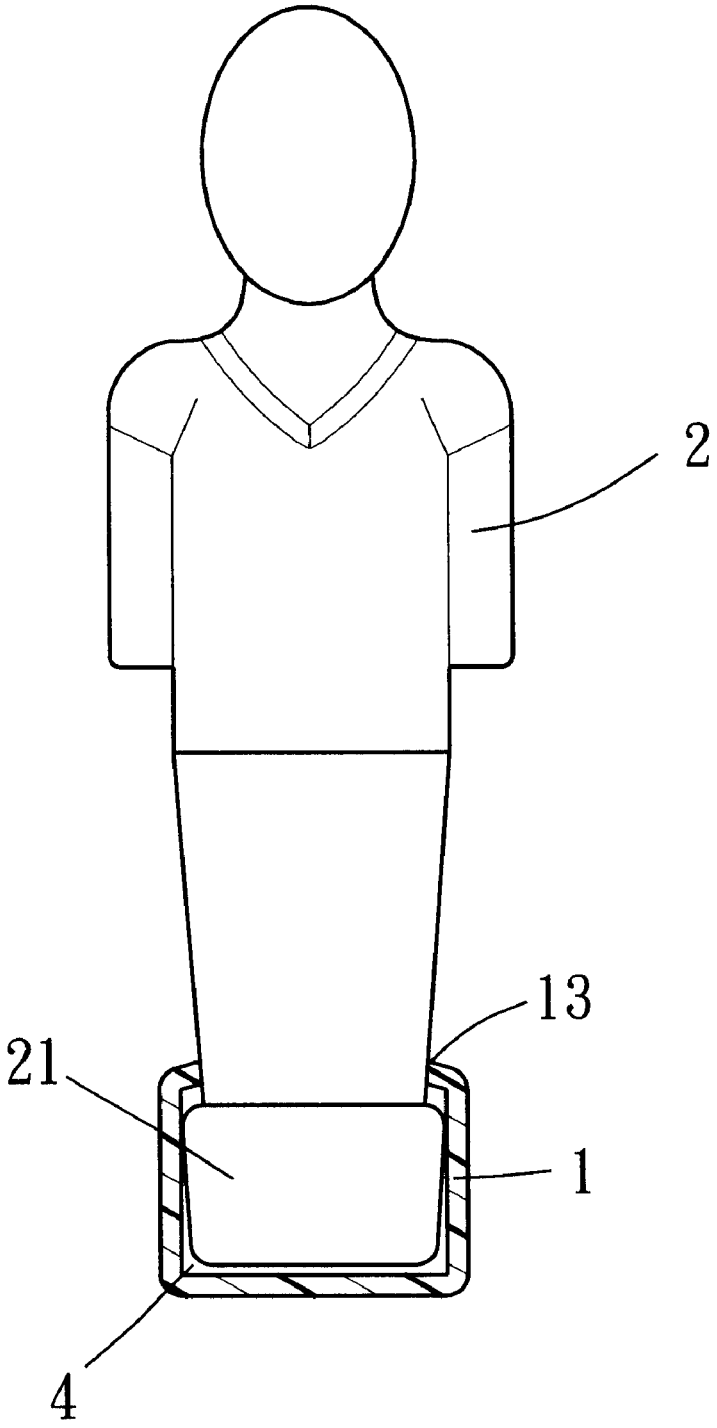
FIG. 5 is a front view of the foot shell of toy football player for a toy football field in the practical using condition; and, FIG. 6 is an upper view of the foot shell in receiving a ball in the present invention.

A preferred embodiment of a foot shell of a toy football player for a toy football field in the present invention, as shown in FIG. 4, is made integral of a soft material, having a hollow interior, a concave receiving surface 11 formed in a front side generally about a vertical axis from adjacent an upper side to adjacent a lower side of the foot shell, a plurality of vertical rough stripes 12 formed in the concave receiving surface 11. The foot shell 1 further has a rather small hole formed in an upper side to communicate with the hollow interior 14. After the foot shell 1 is fixed around a ball kicking block 21 of the toy football player 2 as shown in FIG. 5, the small hole 13 constricts an upper portion of the ball kicking block 21, with the ball kicking block 21 fitting in the hollow interior 14 and preventing the foot shell 1 from falling off the ball kicking block 21.

Figure 6:
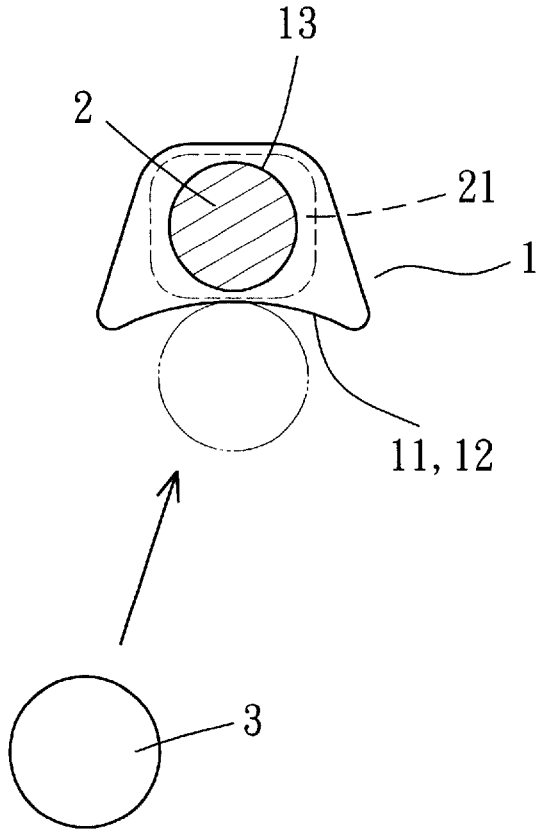

Next, as shown in FIG. 6, after the foot shell 1 is fixed around the ball kicking block 21, and when the ball rolls to the foot shell 1, the concave surface 11 receiving the ball 3 may easily stop and stabilize it, which may smoothly stop and stabilize, ready for kicking, having the similar function that a true player receives and stops the ball with its curved inner side of the foot.

I claim:

1. A foot shell of a toy football player for a toy football field comprising:

a hollow interior with a receiving hole formed in an upper side of said hollow interior, said receiving hole receives the toy football player to connect said foot shell to said toy football player, said foot shell being formed from a soft, shock absorbing material; wherein said foot shell comprises a concave surface formed in a front side of said foot shell generally about a vertical axis from adjacent said upper side to adjacent a lower side of said foot shell so as to easily stop and control a football to enhance a receiving effect and to stabilize the football.

2. The foot shell of a toy football player for a toy football field as claimed in claim 1, wherein:

said concave surface comprises a plurality of textured friction strips.

* * * * *